US009121120B2

(12) United States Patent
Ciaramitaro

(10) Patent No.: US 9,121,120 B2
(45) Date of Patent: Sep. 1, 2015

(54) IMAGED FABRIC WITH EMBROIDERY

(71) Applicant: Stahls' SCS, St. Clair Shores, MI (US)

(72) Inventor: Fred Ciaramitaro, Eastpointe, MI (US)

(73) Assignee: Stahls' SCS, St. Clair Shores, MI (US)

( * ) Notice: Subject to any disclaimer, the term of this patent is extended or adjusted under 35 U.S.C. 154(b) by 8 days.

(21) Appl. No.: 14/024,037

(22) Filed: Sep. 11, 2013

(65) Prior Publication Data

US 2014/0069309 A1 Mar. 13, 2014

Related U.S. Application Data

(60) Provisional application No. 61/699,636, filed on Sep. 11, 2012.

(51) Int. Cl.

| | |
|---|---|
| ***D05B 3/00*** | (2006.01) |
| ***D05C 17/00*** | (2006.01) |
| ***D06Q 1/10*** | (2006.01) |
| *D06Q 1/00* | (2006.01) |
| *D06Q 1/12* | (2006.01) |

(52) U.S. Cl.

CPC *D05C 17/00* (2013.01); *D06Q 1/10* (2013.01); *D06Q 1/005* (2013.01); *D06Q 1/12* (2013.01)

(58) Field of Classification Search

CPC ..... D05C 17/00

USPC ..... 112/475.18, 475.01, 475.09, 475.19, 112/78, 470.06; 101/33, 34; 428/90, 101, 428/102, 99, 190, 200

See application file for complete search history.

(56) References Cited

U.S. PATENT DOCUMENTS

| | | | | |
|---|---|---|---|---|
| 2,456,264 | A * | 12/1948 | Friedlen | 28/164 |
| 4,140,563 | A * | 2/1979 | Sernaker | 156/148 |
| 5,438,520 | A * | 8/1995 | Satoh et al. | 700/132 |
| 5,740,055 | A * | 4/1998 | Iwata | 700/139 |
| 5,758,588 | A * | 6/1998 | Orfali | 112/475.08 |
| 6,752,075 | B2 * | 6/2004 | Ciaramitaro et al. | 101/33 |
| 8,171,867 | B2 * | 5/2012 | Roche | 112/117 |
| 8,354,154 | B2 * | 1/2013 | Mason et al. | 428/61 |
| 8,544,399 | B2 * | 10/2013 | Miloslavsky | 112/475.18 |

* cited by examiner

*Primary Examiner* — Tejash Patel

(74) *Attorney, Agent, or Firm* — Fishman Stewart Yamaguchi PLLC

(57) ABSTRACT

Exemplary methods of making an applique are disclosed. Exemplary methods may include providing a fabric layer, and transferring a graphic onto the fabric layer, the graphic having a plurality of registration marks configured to align an embroidery contour. The methods may further include creating an adjusted embroidery contour using at least the registration marks, and applying an embroidery along the adjusted embroidery contour.

22 Claims, 3 Drawing Sheets

IMAGED FABRIC WITH EMBROIDERY

CROSS-REFERENCE TO RELATED APPLICATIONS

This application claims priority to U.S. Provisional Application Ser. No. 61/699,636, filed on Sep. 11, 2012, the contents of which are hereby expressly incorporated by reference in its entirety.

BACKGROUND

Fabric layers are commonly sewn together on garments for purposes of decoration. A layer of fabric used in this way is commonly called an "appliqué." Appliqués may be used for decorative purposes and also to reduce the amount of individual stitches required to create the finished design.

However, known approaches to making an applique usually require the embroiderer to lay out multiple pieces of fabric to form the design, and then joining the fabric layers together. This process is very time and labor intensive.

Accordingly, there is a need for an improved applique and method of making the same that address the above problems.

BRIEF DESCRIPTION OF THE DRAWINGS

While the claims are not limited to the illustrated embodiments, an appreciation of various aspects is best gained through a discussion of various examples thereof. Referring now to the drawings, illustrative embodiments are shown in detail. Although the drawings represent the embodiments, the drawings are not necessarily to scale and certain features may be exaggerated to better illustrate and explain an innovative aspect of an embodiment. Further, the embodiments described herein are not intended to be exhaustive or otherwise limiting or restricting to the precise form and configuration shown in the drawings and disclosed in the following detailed description. Exemplary embodiments of the present invention are described in detail by referring to the drawings as follows.

DETAILED DESCRIPTION

Figure 1:
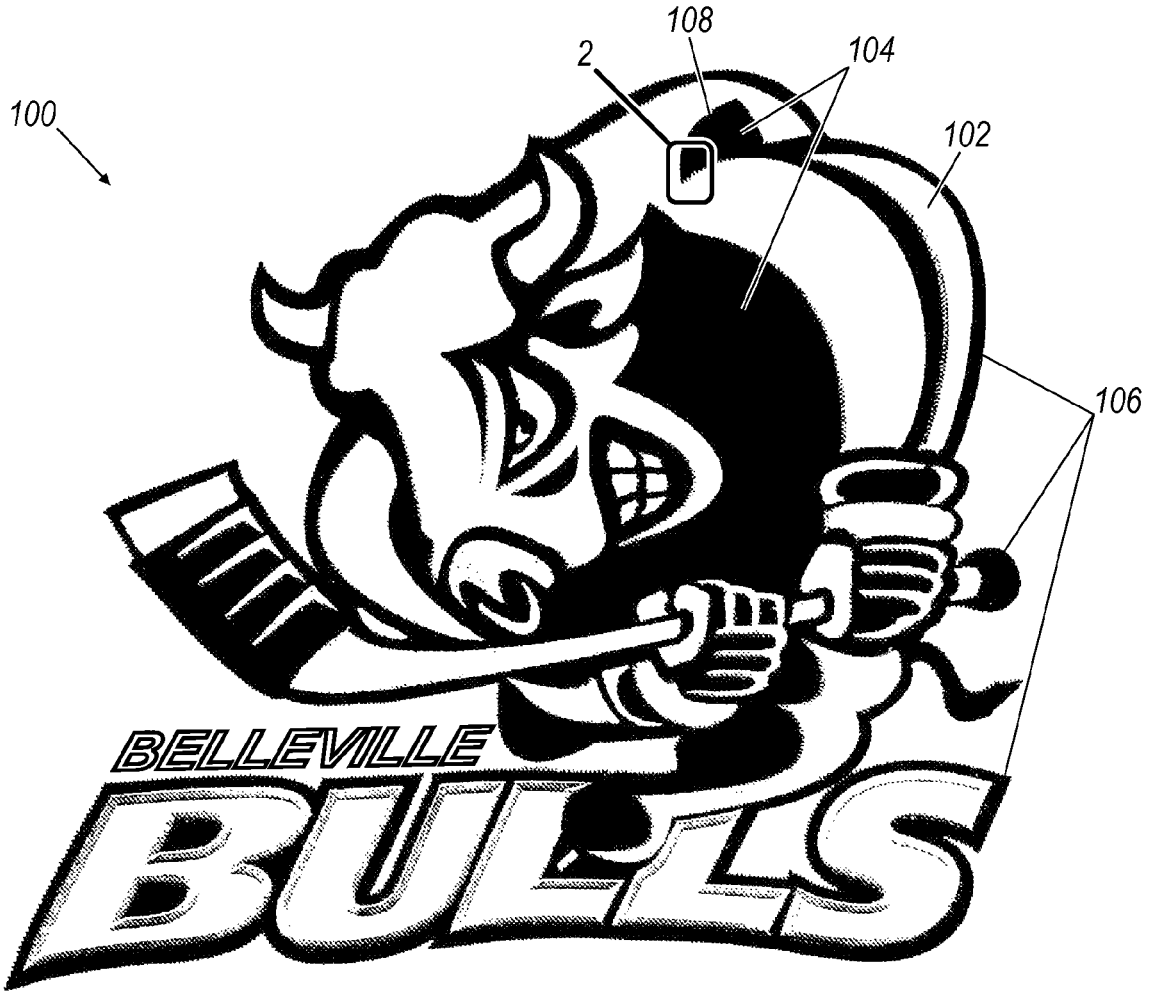
FIG. 1 is an illustration of an exemplary applique.

Referring now to the drawings, illustrative embodiments are shown in detail. Although the drawings represent the embodiments, the drawings are not necessarily to scale and certain features may be exaggerated to better illustrate and explain an innovative aspect of an embodiment. Further, the embodiments described herein are not intended to be exhaustive or otherwise limit or restrict the invention to the precise form and configuration shown in the drawings and disclosed in the following detailed description.

Exemplary methods of making an applique may include providing a fabric layer, and transferring a graphic onto the fabric layer, the graphic having a plurality of registration marks configured to align an embroidery contour. The methods may further include creating an adjusted embroidery contour using at least the registration marks, and applying an embroidery along the adjusted embroidery contour.

Exemplary methods of adjusting an embroidery contour for an applique may include applying a heat to a plurality of fabric pieces to determine an adjustment factor, and providing a first fabric layer. The exemplary methods may further include transferring a graphic onto the first fabric layer, with the graphic having a plurality of registration marks configured to align an embroidery contour, and creating an adjusted embroidery contour using at least the registration marks and the adjustment factor. In some exemplary illustrations, the adjustment factor approximates a shrinkage of the fabric layer resulting from a heat applied during the transferring of the graphic onto the fabric layer.

Figure 2:
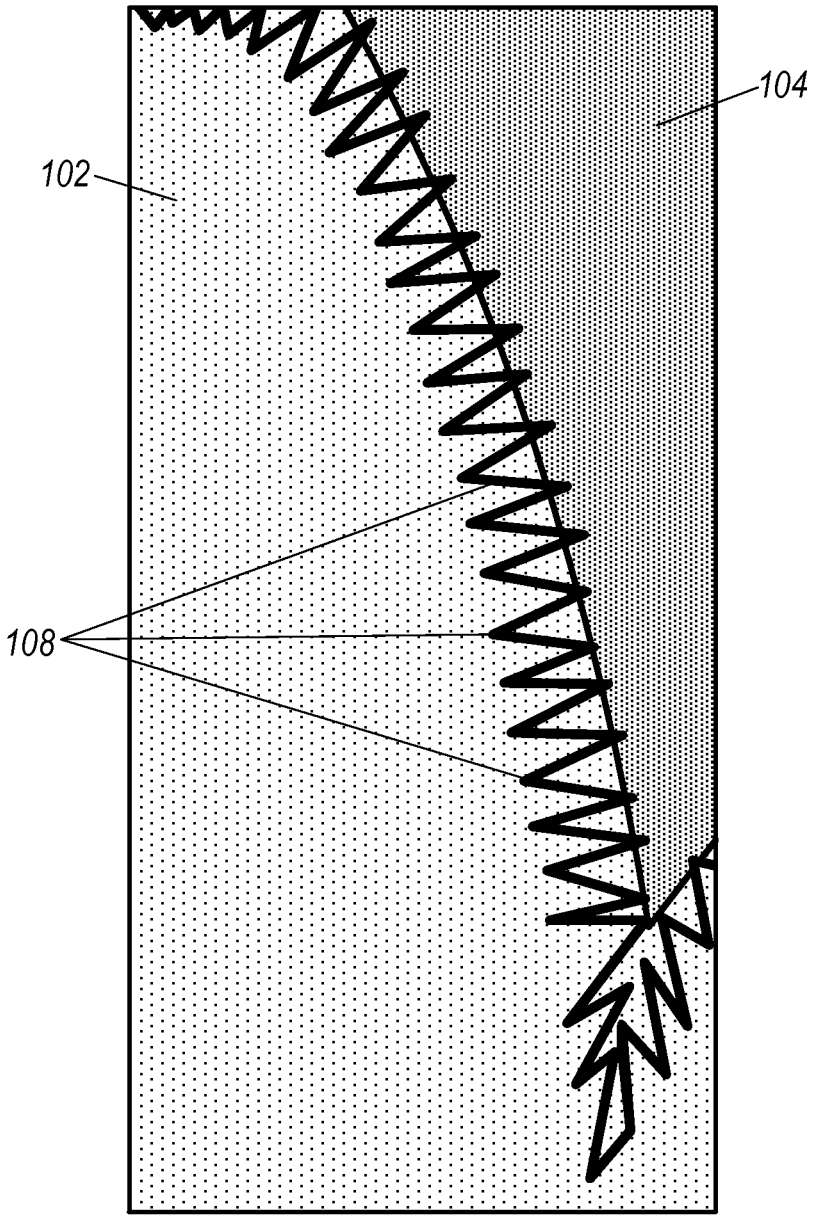
FIG. 2 is an enlarged view of a portion of the exemplary applique of FIG. 1.
Figure 3:
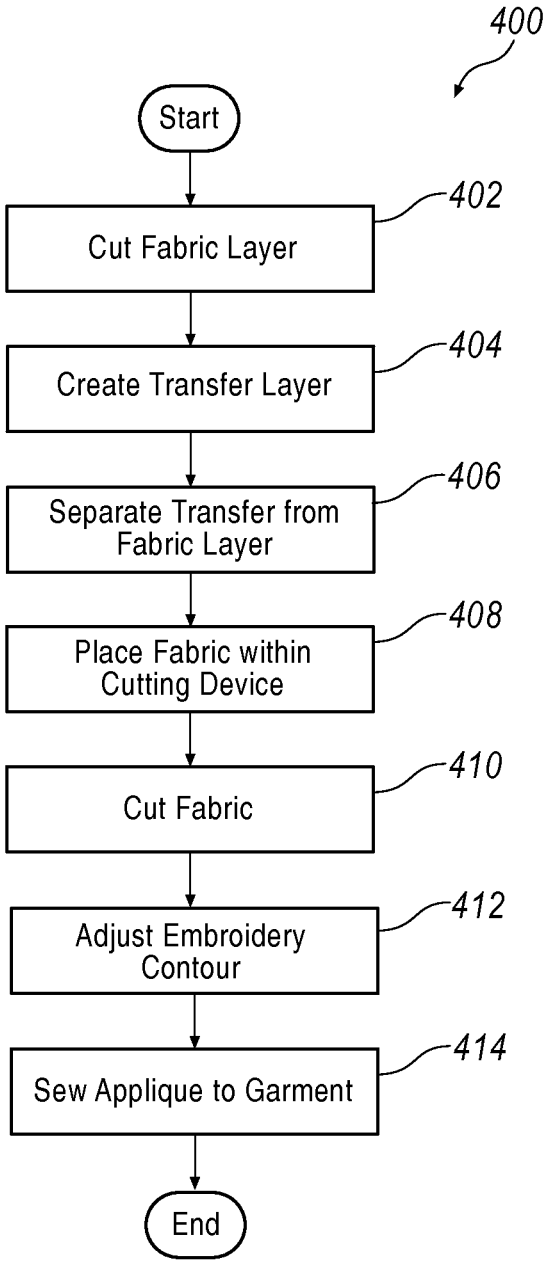
FIG. 3 is a process flow diagram for an exemplary method of making an applique.

Turning now to FIGS. 1, 2, and 3, an exemplary applique 100 is shown. Generally, a single layer of fabric 102 may be imaged with a graphic or pattern 104, and then cut with a corresponding cut contour 106 defining an outer perimeter of the applique. The applique may then be embroidered with specially registered embroidery 108 within the outer perimeter, thereby creating the appearance of multiple layers of fabric sewn together within the outer perimeter of the applique. More specifically, the graphic or pattern 104 that is imaged on top of the single fabric layer 102 may give the appearance of multiple pieces of fabric joined along the border defined by the embroidery 108. In one exemplary illustration, the applique 100 may appear to be comprised of (1) a darker fabric represented by the pattern 104 and (2) a lighter fabric represented by the fabric layer 102. The two "portions" may appear to be stitched or held together by the embroidery 108.

Accordingly, the exemplary applique 100 generally gives the appearance of multiple layers of fabric sewn together in conjunction with decorative embroidery embellishment, but only requires a single layer of fabric 102 to do so. The use of a single layer 102 saves labor time and costs and also results in a final product that is lighter in weight and thickness, which is a favorable feature for garment decoration. The printed layer 104 may add little if any thickness to the fabric layer 102, thereby resulting in an applique 100 that is substantially the same thickness as the single layer 102 despite the appearance of multiple layers.

To create the appearance of multiple layers of fabric, a single layer of fabric may be imaged using an imaging process. In one exemplary approach, a sublimation process may be used. In one example a sublimation process uses heat to transfer a dye onto the fabric layer 102. The fabric layer 102 may thus be imaged with a one or more colored graphic regions. Moreover, the fabric layer may be imaged with a plurality of colors. The plurality of regions and/or different colors may thus give the appearance of multiple layers of fabric.

A sublimation process may require high heat to apply the sublimation transfer to the fabric 102. The high heat can cause the fabric 102 being imaged to shrink in a non-proportional manner. This shrinkage may therefore cause the original embroidery contours of the applique to be mis-registered to the imaged appliqué 100, resulting in an unfavorable appearance.

As such, it may be necessary to account for any shrinkage of the fabric. In one exemplary approach, shrinkage of the fabric layer 102 is calculated and then used to adjust the original embroidery contours, e.g., in a non-proportional manner, causing the adjusted embroidery contours and the "shrunk" imaged appliqué to register together, i.e., such that the intended embroidery 108 matches the edge(s) of the imaged portion 104. The adjustment of the embroidery 108 contour may thereby provide a more favorable appearance for the finished applique 100 by minimizing any mismatch between the contour of the embroidery 108 and the edges of the transfer layer 104.

Accordingly, the imaged appliqué 100 may give the appearance of multiple layers of fabric sewn together in conjunction with decorative embroidery 108 embellishments while only requiring one layer of fabric 102 to do so. Specially calculated and adjusted embroidery contours may be employed to register to the imaged appliqué 100 providing a feasible solution to the problem of fabric shrinkage due to the required high heat application. Moreover, imaged graphics can simulate multiple textures and weaves of fabrics to be included in the single layer appliqué, and customers are generally not limited to the amount of colors visually being simulated as fabric layers. Further, graphical details that are too small to reliably cut and sew from separate fabric layers can be imaged into the single layer appliqué 100, thereby providing feasible options not provided with conventional decorating methods.

Turning now to FIG. 3, an exemplary method 400 of making an applique is illustrated. Process 400 may begin at block 402, where a single layer of fabric, e.g., a polyester twill, is cut to a predetermined size allowing it to fit within the dimensions of a heat press.

Proceeding to block 404, a transfer layer may be created on top of the fabric layer 102. In one exemplary approach, a sublimation transfer 104 is created using a printing device such as a Roland Hi-Fi Express 740 inkjet printer. In one exemplary approach, this transfer 104 may be a mirror image of the graphic to be imaged onto the fabric 102 as well as a series of special registration marks to be used in the cutting process. The layer of fabric 102 may be placed inside of a heat press along with the sublimation transfer, with the transfer "ink side down" to the fabric 102. The transfer may be applied to the fabric layer 102 with a predetermined amount of pressure and temperature for a predetermined amount of time. In one exemplary approach, a transfer 104 is applied using a pressure of 60 psi and a temperature of 340 degrees Fahrenheit for 60 seconds.

Proceeding to block 406, the sublimation transfer may be separated from the fabric 102, leaving the graphic 104 and registration marks transferred to the fabric layer 102. Process 400 may then proceed to block 408.

At block 408, the fabric layer 102 may be placed into a cutting device, e.g., a XY laser cutter, where the registration marks are read by an optical registration system. The optical registration system then makes adjustments, e.g., a non-proportional adjustment, to the original graphic's cutting contour on both its X and Y axes.

Proceeding to block 410, a cutting device may cut through the fabric layer 102 along the adjusted cutting contour, resulting in a separated fabric piece where the imaged graphic area is cut in registration with the cutting contour. Process 400 may then proceed to block 412.

At block 412, the original graphic's embroidery contours may be non-proportionately adjusted by a predetermined percentage amount on both the X and Y axes to compensate for shrinkage of the fabric 102 during the heat application process. These predetermined percentage amounts may, in some exemplary approaches, be based on and calculated from the measurement of multiple heat applied imaged fabric layers. Moreover, in some exemplary approaches, a series of fabrics may have a heat representative of the sublimation transfer applied to determine a projected shrinkage of the fabric layer 102 in the X and/or Y directions.

Proceeding to block 414, the imaged appliqué 100 may be sewn directly onto a garment, e.g., a shirt or sweatshirt, merely as examples, utilizing an embroidery machine. In one example, an automatic embroidery machine such as a Tajima embroidery machine may be employed, using the adjusted embroidery contour, e.g., as determined in block 412, resulting in the embroidery contours and decorative embroidery embellishments being registered properly to the imaged graphic appliqué 100. The final applique 100 may thereby have an appearance of multiple layers of fabric sewn together on the garment. Process 400 may then terminate.

In some exemplary approaches, the exemplary methods described herein may employ a computer or a computer readable storage medium implementing the various methods and processes described herein, e.g., process 400. In general, computing systems and/or devices, such as the processor and the user input device, may employ any of a number of computer operating systems, including, but by no means limited to, versions and/or varieties of the Microsoft Windows® operating system, the Unix operating system (e.g., the Solaris® operating system distributed by Oracle Corporation of Redwood Shores, Calif.), the AIX UNIX operating system distributed by International Business Machines of Armonk, N.Y., the Linux operating system, the Mac OS X and iOS operating systems distributed by Apple Inc. of Cupertino, Calif., and the Android operating system developed by the Open Handset Alliance.

Computing devices generally include computer-executable instructions, where the instructions may be executable by one or more computing devices such as those listed above. Computer-executable instructions may be compiled or interpreted from computer programs created using a variety of programming languages and/or technologies, including, without limitation, and either alone or in combination, Java™, C, C++, Visual Basic, Java Script, Perl, etc. In general, a processor (e.g., a microprocessor) receives instructions, e.g., from a memory, a computer-readable medium, etc., and executes these instructions, thereby performing one or more processes, including one or more of the processes described herein. Such instructions and other data may be stored and transmitted using a variety of computer-readable media.

A computer-readable medium (also referred to as a processor-readable medium) includes any non-transitory (e.g., tangible) medium that participates in providing data (e.g., instructions) that may be read by a computer (e.g., by a processor of a computer). Such a medium may take many forms, including, but not limited to, non-volatile media and volatile media. Non-volatile media may include, for example, optical or magnetic disks and other persistent memory. Volatile media may include, for example, dynamic random access memory (DRAM), which typically constitutes a main memory. Such instructions may be transmitted by one or more transmission media, including coaxial cables, copper wire and fiber optics, including the wires that comprise a system bus coupled to a processor of a computer. Common forms of computer-readable media include, for example, a floppy disk, a flexible disk, hard disk, magnetic tape, any other magnetic medium, a CD-ROM, DVD, any other optical medium, punch cards, paper tape, any other physical medium with patterns of holes, a RAM, a PROM, an EPROM, a FLASH-EEPROM, any other memory chip or cartridge, or any other medium from which a computer can read.

Databases, data repositories or other data stores described herein may include various kinds of mechanisms for storing, accessing, and retrieving various kinds of data, including a hierarchical database, a set of files in a file system, an application database in a proprietary format, a relational database management system (RDBMS), etc. Each such data store is generally included within a computing device employing a computer operating system such as one of those mentioned above, and are accessed via a network in any one or more of a variety of manners. A file system may be accessible from a computer operating system, and may include files stored in various formats. An RDBMS generally employs the Structured Query Language (SQL) in addition to a language for creating, storing, editing, and executing stored procedures, such as the PL/SQL language mentioned above.

In some examples, system elements may be implemented as computer-readable instructions (e.g., software) on one or more computing devices (e.g., servers, personal computers, etc.), stored on computer readable media associated therewith (e.g., disks, memories, etc.). A computer program product may comprise such instructions stored on computer readable media for carrying out the functions described herein.

The exemplary illustrations are not limited to the previously described examples. Rather, a plurality of variants and modifications are possible, which also make use of the ideas of the exemplary illustrations and therefore fall within the protective scope. Accordingly, it is to be understood that the above description is intended to be illustrative and not restrictive.

With regard to the processes, systems, methods, heuristics, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating certain embodiments, and should in no way be construed so as to limit the claimed invention.

Accordingly, it is to be understood that the above description is intended to be illustrative and not restrictive. Many embodiments and applications other than the examples provided would be upon reading the above description. The scope of the invention should be determined, not with reference to the above description, but should instead be determined with reference to the appended claims, along with the full scope of equivalents to which such claims are entitled. It is anticipated and intended that future developments will occur in the arts discussed herein, and that the disclosed systems and methods will be incorporated into such future embodiments. In sum, it should be understood that the invention is capable of modification and variation and is limited only by the following claims.

All terms used in the claims are intended to be given their broadest reasonable constructions and their ordinary meanings as understood by those skilled in the art unless an explicit indication to the contrary in made herein. In particular, use of the singular articles such as "a," "the," "the," etc. should be read to recite one or more of the indicated elements unless a claim recites an explicit limitation to the contrary.

What is claimed is:

1. A method of manufacturing an applique, comprising:
providing a fabric layer;
transferring a graphic onto the fabric layer, the graphic having a plurality of registration marks configured to align an embroidery contour;
determining an adjustment factor corresponding to an application of heat to the fabric layer;
creating an adjusted embroidery contour using at least the registration marks and the adjustment factor; and
applying an embroidery along the adjusted embroidery contour.

2. The method of claim 1, further comprising applying a heat to a plurality of fabric pieces to determine the adjustment factor.

3. The method of claim 1, wherein creating the adjusted embroidery contour includes adjusting the registration marks based at least in part upon the adjustment factor.

4. The method of claim 1, wherein applying the embroidery includes securing the fabric layer to a garment.

5. The method of claim 1, further comprising providing a sublimation transfer, the sublimation transfer including the graphic.

6. The method of claim 1, further comprising cutting the fabric layer to define an outer contour of the applique.

7. The method of claim 1, further comprising establishing the graphic as having a different color than the fabric layer.

8. The method of claim 1, further comprising establishing the graphic as having at least two colors, the at least two colors each being different from a color of the fabric layer.

9. The method of claim 2, wherein the adjustment factor approximates a shrinkage of the fabric layer resulting from a heat applied during the transferring of the graphic onto the fabric layer.

10. A method of manufacturing an applique, comprising:
providing a fabric layer;
providing a sublimation transfer including a graphic;
transferring the graphic onto the fabric layer from the sublimation transfer, the graphic having a plurality of registration marks configured to align an embroidery contour;
determining an adjustment factor corresponding to an application of heat to the fabric layer;
creating an adjusted embroidery contour using at least the registration marks and the adjustment factor; and
applying an embroidery along the adjusted embroidery contour.

11. The method of claim 10, further comprising applying a heat to a plurality of fabric pieces to determine the adjustment factor.

12. The method of claim 10, wherein creating the adjusted embroidery contour includes adjusting the registration marks based at least in part upon the adjustment factor.

13. The method of claim 10, wherein applying the embroidery includes securing the fabric layer to a garment.

14. The method of claim 10, further comprising cutting the fabric layer to define an outer contour of the applique.

15. The method of claim 10, further comprising establishing the graphic as having a different color than the fabric layer.

16. The method of claim 10, further comprising establishing the graphic as having at least two colors, the at least two colors each being different from a color of the fabric layer.

17. The method of claim 11, wherein the adjustment factor approximates a shrinkage of the fabric layer resulting from a heat applied during the transferring of the graphic onto the fabric layer.

18. A method of adjusting an embroidery contour for an applique, comprising:
applying a heat to a plurality of fabric pieces to determine an adjustment factor;
providing a first fabric layer;
transferring a graphic onto the first fabric layer, the graphic having a plurality of registration marks configured to align an embroidery contour; and
creating an adjusted embroidery contour using at least the registration marks and the adjustment factor, wherein the adjustment factor approximates a shrinkage of the fabric layer resulting from a heat applied during the transferring of the graphic onto the fabric layer.

19. The method of claim 18, further comprising applying an embroidery along the adjusted embroidery contour.

20. The method of claim 18, further comprising providing a sublimation transfer, the sublimation transfer including the graphic.

21. The method of claim 1, wherein applying the embroidery includes sewing the fabric layer.

22. The method of claim 1, wherein creating the adjusted embroidery contour includes making a non-proportional adjustment.

* * * * *